United States Patent [19]

Dastur et al.

[11] 4,055,507

[45] Oct. 25, 1977

[54] METHYLPENTANE/$CCLF_2CH_2CL$ AZEOTROPIC MIXTURES

[75] Inventors: Kavsy D. Dastur, Yorklyn; Robert A. Gorski, Newark, both of Del.

[73] Assignee: E. I. Du Pont de Nemours and Company, Wilmington, Del.

[21] Appl. No.: 645,698

[22] Filed: Dec. 31, 1975

[51] Int. Cl.[2] ..... C11D 7/30; C11D 7/24; C23G 5/02

[52] U.S. Cl. ..... 252/162; 134/31; 134/38; 134/40; 252/364; 252/DIG. 9

[58] Field of Search ..... 252/171, 170, DIG. 9, 252/67, 364, 162; 134/40, 38, 31; 203/67, 70; 260/648 F, 652.5 R, 653, 653.6, 653.7, 653.8

[56] References Cited

U.S. PATENT DOCUMENTS

| | | | |
|---|---|---|---|
| 3,042,479 | 7/1962 | Laurence, Jr. et al | 252/171 |
| 3,201,482 | 8/1965 | Fredenberg | 260/652.5 R |
| 3,249,546 | 5/1966 | Eiseman, Jr. | 252/67 |
| 3,349,009 | 10/1967 | Ruehlen | 203/67 |
| 3,431,211 | 3/1969 | Bauer et al. | 252/67 |
| 3,819,493 | 6/1974 | Fozzard | 203/70 |
| 4,024,086 | 5/1977 | Hutchinson | 252/162 |

*Primary Examiner*—Harris A. Pitlick

[57] ABSTRACT

Azeotropic mixtures of 3-methylpentane and 1,2-dichloro-1,1-difluoroethane useful in solvent cleaning applications.

3 Claims, 1 Drawing Figure

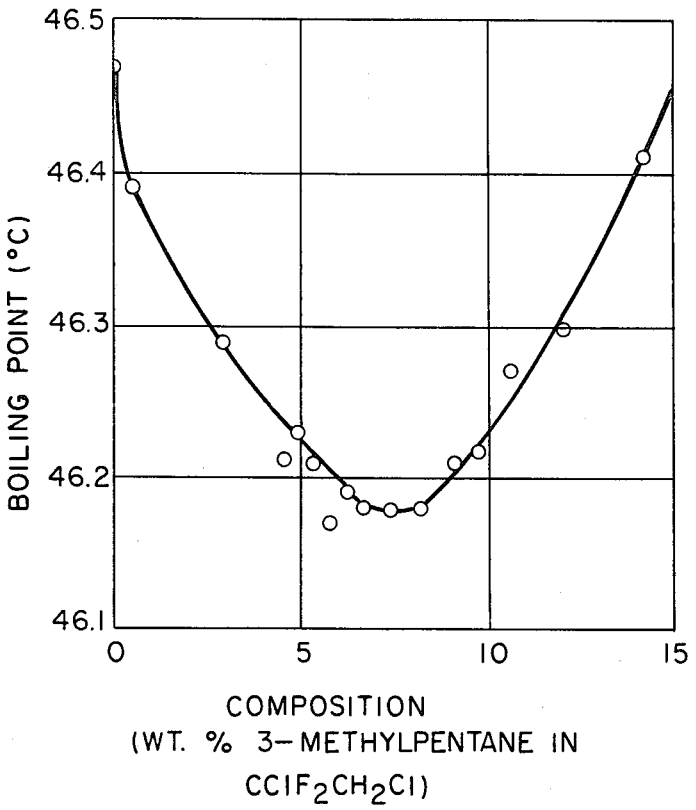
46.5
46.4
46.3
46.2
46.1
BOILING POINT (°C)
0
5
10
15
COMPOSITION
(WT. % 3-METHYLPENTANE IN
CClF2CH2Cl)

METHYLPENTANE/$CCLF_2CH_2CL$ AZEOTROPIC MIXTURES

BACKGROUND OF THE INVENTION

Electronic circuitry such as printed circuits found in television receivers, copying machines, and missile guidance systems is often so intricate that the only possible method of cleaning foreign accumulations from such circuits is contacting with a volatile organic solvent until the accumulations are dissolved, removing the circuits from contact with the solvent and allowing the solvent remaining on the circuits to evaporate.

The requirements for such cleaning solvents are stringent. A solvent should be low boiling, non-flammable, non-toxic and should also exhibit a high solvent power for the residues to be removed without attacking the substrate being cleaned. While boiling and flammability characteristics can often be adjusted by preparing mixtures of solvents, these are often unsatisfactory because they fractionate to an undesirable degree during use. Such mixtures also fractionate during recovery, making it difficult to recover a solvent mixture with the original composition.

SUMMARY OF THE INVENTION

The present invention provides an azeotropic composition which is well suited for solvent cleaning applications.

Specifically, the instant invention provides an azeotrope-like composition consisting essentially of about from 4 to 10 weight percent 3-methylpentane and about from 96 to 90 weight percent $CClF_2CH_2Cl$.

BRIEF DESCRIPTION OF THE DRAWING

The FIGURE is a graphical representation of the boiling point at 760 millimeters of mercury in degrees centigrade of various 3-methylpentane/$CClF_2CH_2Cl$ compositions.

DETAILED DESCRIPTION OF THE INVENTION

The compositions of the instant invention consist of 3-methylpentane (b.p. 60.271° C.) and $CClF_2CH_2Cl$, 1,2-dichloro-1,1-difluoroethane (b.p. 46.47° C.). This latter material is known in the nomenclature conventional to the chlorofluorocarbon field as fluorocarbon 132*b*. The 3-methylpentane used can be of normal commercial purity, comprising at least about 95% 3-methylpentane. The present mixtures of 4 to 10 weight percent 3-methylpentane and 90 to 96 weight percent $CClF_2CH_2Cl$ are azeotropic in nature, in that compositions within this range exhibit a substantially constant boiling point. Being substantially constant boiling, the mixture does not tend to fractionate to any great extent upon evaporation. After evaporation, only a small difference exists between the composition of the vapor phase and the composition of the initial liquid phase. This difference is so small that the compositions of the vapor and liquid phases are considered substantially identical. Accordingly, any mixture within this range exhibits properties which are characteristic of a true binary azeotrope. Compositions comprising about from 6 to 8 weight percent 3-methylpentane and about from 94 to 92 weight percent $CClF_2CH_2Cl$ have been found to exhibit particularly satisfactory performance. The composition consisting of about 7.4 weight percent 3-methylpentane and about 92.6 weight percent $CClF_2CH_2Cl$ has been established, within the accuracy of the boiling point determination procedure, as the true binary azeotrope, boiling at about 46.18° C.

The azeotropic nature of the present mixtures is confirmed by experimentation summarized in the accompanying graph. 1,2-Dichloro-1,1-difluoroethane in a known amount was charged into a dry 2-neck round-bottom flask fitted with a calibrated addition funnel and a reflux condenser having at its upper end a calcium sulfate drying tube and inside the condenser a calibrated thermometer so suspended as to place the bulb, wetted by condensate, in the vapor space.

The dichlorodifluoroethane was heated to reflux by means of an electric heating mantle. From time to time 3-methylpentane was added incrementally through the addition funnel. After each addition the system was allowed to equilibrate until the observed temperature of the vapor was constant. The barometric pressure was periodically recorded and the observed boiling points were corrected to 760 millimeters of mercury pressure. The results of the determinations are summarized in the graph, in which the composition of the mixture is represented as the weight percent of 3-methylpentane in $CClF_2CH_2Cl$. The constancy of the boiling point over the composition range of about from 4 to 10 weight percent 3-methylpentane indicates the presence of the minimum boiling azeotrope. The minimum boiling point in this curve establishes the true binary azeotrope at about 7.4 weight percent 3-methylpentane and about 92.6 weight percent $CClF_2CH_2Cl$.

The azeotropic compositions of the present invention can be used in a wide variety of solvent cleaning applications, including the removal of soldering flux from circuit boards. Typically a circuit board consists of a plate of electrically resistant reinforced plastic having an electrically conductive circuit adhered to one side. Holes passing through the plate at an appropriate part of the circuit provide access for leads of electrical components, normally mounted on the side of the board opposite the circuit. The electrical components are generally soldered to insure the electrical integrity of the connections.

Modern industrial processes of soldering circuit boards comprise coating the circuit side of the board with a rosin flux, frequently activated with amine hydrochloride and oxalic acid additives. Thereafter the circuit side of the board is passed through a molten solder to coat all remaining exposed parts.

The azeotropic compositions can be used to remove the flux and other residues remaining on the board after the soldering operation. Vapor degreasers are generally used for applying solvent to the circuit boards. In the usual operation of a vapor degreaser, the board is passed through a sump of boiling solvent, which removes the majority of the flux; thereafter through a sump containing freshly distilled solvent at or near room temperature; and finally through solvent vapors over the boiling sump which provide a final rinse with clean pure solvent condensed on the board. The cleaning process can optionally further comprise agitation to facilitate removal of the residues, including ultrasonic agitation of the cleaning agent.

The compositions of the present invention are sufficiently aggressive to remove the flux generally used in the preparation of circuit boards, but not so aggressive as to damage the boards prepared from reinforced polymeric materials conventionally used for circuit boards, or the electronic components usually mounted thereon. $CClF_2CH_2Cl$ is a somewhat stronger solvent than 1,1,2-trichloro-1,2,2-trifluoroethane which is often used in such cleaning operations, alone or in mixture with other materials such as ethanol. The present azeotropes of 3-methylpentane, a mild hydrocarbon solvent, and $CClF_2CH_2Cl$ thus provide a particularly satisfactory cleaning solvent in those applications requiring a mild solvent, while permitting easy recovery and reuse of the solvent from vapor defluxing systems because of their azeotropic nature.

The following procedure is representative of cleaning operations to which the present azeotropic mixtures are applicable. Substantially equivalent results will be obtained in such a procedure using any of the azeotropic mixtures of the present invention.

EXAMPLE

A single-sided circuit board is coated with activated rosin flux and soldered by passing the board through molten solder. The soldered board is defluxed in a two-bath solvent degreaser containing an azeotropic mixture of 7.4 weight percent 3-methylpentane and about 92.6 weight percent $CClF_2CH_2Cl$. The circuit board is defluxed by suspending it for 4 minutes in the boil sump, 1 minute in the rinse sump maintained at a temperature of about 35° C, and 30 seconds in the solvent vapor.

Visually satisfactory cleaning of the circuit board will result from the procedure.

We claim:

1. An azeotropic composition consisting essentially of about from 4 to 10 weight percent 3-methylpentane and about from 96 to 90 weight percent $CClF_2CH_2Cl$.

2. An azeotropic composition of claim 1 consisting essentially of about from 6 to 8 weight percent 3-methylpentane and about from 94 to 92 weight percent $CClF_2CH_2Cl$.

3. An azeotropic composition of claim 1 consisting essentially of about 7.4 weight percent 3-methylpentane and about 92.6 weight percent $CClF_2CH_2Cl$.

* * * * *